United States Patent [19]

Newbery et al.

[11] Patent Number: 4,839,625

[45] Date of Patent: Jun. 13, 1989

[54] FUSE

[75] Inventors: Percy G. Newbery, Leicester; Nigel P. M. Nurse, West Bridgeford, both of United Kingdom

[73] Assignee: Brush Fusegear Limited, Leicestershire, England

[21] Appl. No.: 196,142

[22] Filed: May 19, 1988

[30] Foreign Application Priority Data

May 19, 1987 [GB] United Kingdom ..... 8711828

[51] Int. Cl.[4] ..... H01H 85/04

[52] U.S. Cl. ..... 337/166; 337/158

[58] Field of Search ..... 337/158–166

[56] References Cited

U.S. PATENT DOCUMENTS 3,810,063 5/1974 Blewitt ..... 337/166

4,506,310 3/1985 Schwarz ..... 337/166

FOREIGN PATENT DOCUMENTS 1221387 2/1971 United Kingdom ..... 337/166

*Primary Examiner*—H. Broome

*Attorney, Agent, or Firm*—Spensley Horn Jubas & Lubitz

[57] ABSTRACT

A fuse comprising a body (20) encapsulating a fuse element (22), said body (20) including a baseplate (16) formed from a material having good thermal conductivity; a pair of elongate terminals (12) being connected at one end to the baseplate (16) through the intermediary of a layer of electrically insulating, heat conducting material (26) so as to extend away therefrom and project from said body (20); the fuse element (22) being provided between the terminals (12) within the body and being surrounded by an arc quenching material (24).

7 Claims, 2 Drawing Sheets

FUSE

The present invention relates to an electrical fuse.

Conventionally, a fuse is mounted in electrical equipment such as semi-conductor converters with a view to the fuse being readily replaced in the event of a fault occuring. During use of the electrical equipment, a considerable quantity of heat can be generated in the fuse itself which has to be dissipated. To overcome this problem it has previously been proposed to provide fins on the end terminals of a fuse or to provide a cooling airstream around it.

It is known to mount power semi-conductors or fuses for example on a heatsink. In this way, the semi-conductor rating can be increased typically by a five-fold increase in current carrying capability. However, previously proposed designs such as those disclosed in GB No. 1,204,505, GB No. 1,114,325, U.S. Pat. No. 4,050,045, U.S. Pat. No. 4,146,861 and U.S. Pat. No. 3,810,063 all suffer from the problem of effective heat dissipation from the fuse body at high current loading while maintaining a high safety factor.

In accordance with the broadest aspect of the present invention, there is provided a fuse comprising a body encapsulating a fuse element, said body including a baseplate formed from a material having good thermal conductivity; a pair of elongate terminals being connected at one end to the baseplate through the intermediary of a layer of electrically insulating, heat conducting material so as to extend away therefrom and project from said body; the fuse element being provided between the terminals within the body and being surrounded by an arc quenching material.

The construction of the present invention allows the fuse to carry high current loadings due to the connection of the terminals to the baseplate which acts as a heatsink. The fuse is separated from the heatsink by a layer of material which is an electrical insulator but which nevertheless has good thermal conductivity may be provided between the fuse and heatsink. Suitable materials are silicone rubber or metallised ceramics. The fuse element is encapsulated within a body formed either from an insulating material such as plastics mounted on the baseplate or within a housing formed integrally with a metal baseplate and closed by a sealing member.

The baseplate forming part of the fuse construction acts as a heatsink but the fuse may also be mounted upon a heatsink which already forms part of the electrical equipment which is to be fused. When the electrical equipment is an electrical converter for example the heatsink is often the largest single component so that there tends not to be an access problem even if the heatsink is not located adjacent an access panel for the electrical equipment.

The invention will now be described further by way of example with reference to the accompanying drawings in which:

FIG. 1 shows a conventional fuse 10 the terminals 12 of which are inwardly rather outwardly directed, each terminal including an aperture by means of which an electrical connection can be made to the fuse. The fuse

Figure 1:
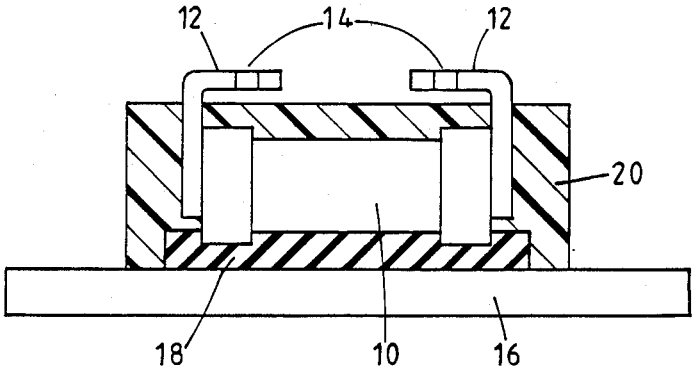
FIGS. 1 to 5 are sectional side elevational views, each figure representing a fuse according to a different embodiment of the invention.

10 is mounted upon a metal base which forms a heatsink therefor by way of a layer of electrical insulation 18 which serves to prevent electrical connection between the terminals 12 and the base 16. In addition to being an electrical insulator, the layer 18 must also have good thermal conductivity properties to enable heat generated in the fuse to be dissipated in the heatsink 16. In the illustrated embodiment of the invention the layer 18 is a sheet of silicone rubber. The fuse 10 and the layer 18 are encapsulated within an insulating housing 20 the base of which is secured to the heatsink 16.

In FIGS. 2 to 5, some of the components are similar to those described in the embodiment illustrated in FIG. 1 and those components have been given similar reference numerals.

Figure 2:
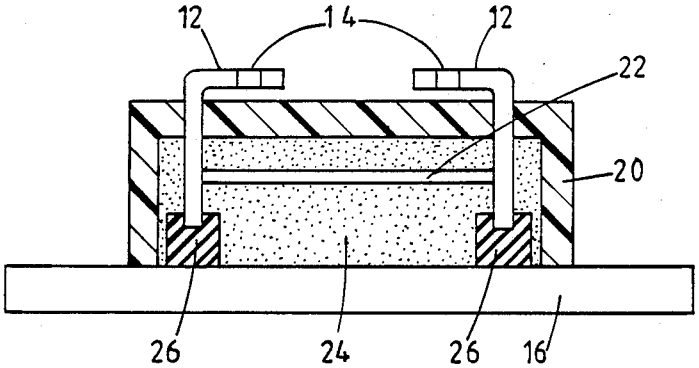

In FIG. 2 the fuse element electrically connecting the two terminals 12 is designated 22. An arc quenching filler material, typically granular quartz, 24, is contained within the encapsulation 20 and completely surrounds the fuse element 22. A block 26 of silicone rubber spaces each of the terminals 12 from the heatsink 16 so that the heatsink does not become live when the fuse is in use. Alternatively, each block 26 may be of a ceramic or plastics material including nylon.

One of the differences between the fuse constructions illustrated in FIG. 1 and FIG. 2 is that in the embodiment illustrated in FIG. 2, the heatsink 16 forms part of the fuse construction whereas in the embodiment of FIG. 1 it does not.

The function of the arc quenching material is to extinguish any arc which may develop across the fuse element when it melts under fault conditions. The use of an arc quenching filler material for this purpose is well known.

Figure 3:
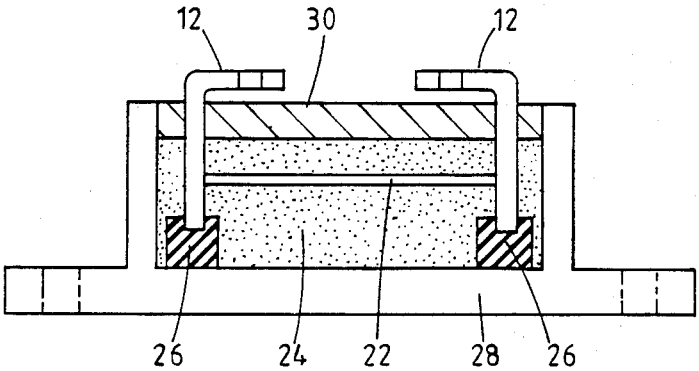

In the fuse illustrated in FIG. 3 the heatsink and outer wall of the fuse are integrally cast from a metal, typically aluminium, the composite cast component being designated 28. Alternatively, a metallic alloy such as brass may be used. The integral body may also be machined from solid metal or metallic alloy. The terminals 12 are insulated from the heatsink base 28 by means of silicone rubber blocks 26 as was described with respect to the embodiment shown in FIG. 2. In the FIG. 3 embodiment the cavity in the casting 28 which contains the terminal and fuse element assembly is closed hermetically by means of a seal 30 of an insulating material, normally plastics.

Figure 4:
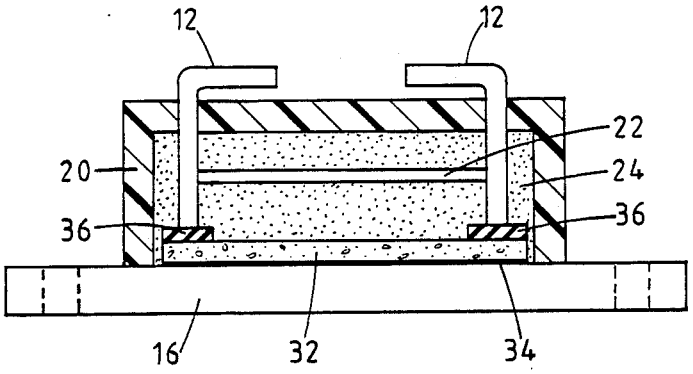

The fuse illustrated in FIG. 4 is of similar construction to that illustrated in FIG. 2 save that the terminals 12 are insulated from the heatsink 16 without the use of silicone rubber blocks 26. A ceramic plate 32 is metallised on both sides, the lower side of the plate being soldered at 34 to the heatsink 16. The terminals 12 are then soldered at 36 to the upper side of the ceramic plates as illustrated at 36.

It will be appreciated that the metallised ceramic plate 32 may also be used in the fuse construction illustrated in FIG. 3.

Figure 5:
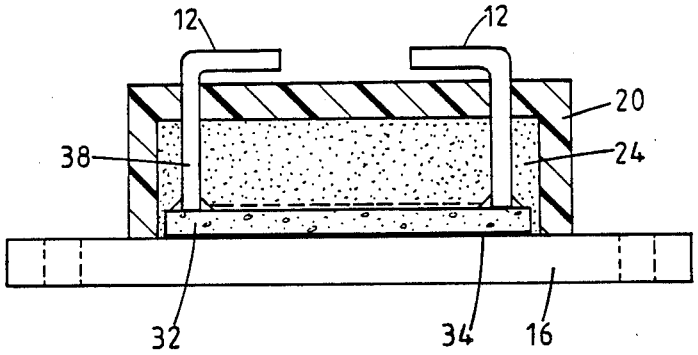

The fuse illustrated in FIG. 5 also embodies a ceramic plate which is metallised on its lower side only and soldered to the heatsink 16. A thin film fuse is deposited upon the upper side of the ceramic plate and the fuse element is contained within the thin film. The terminals 12 are soldered to the thin film, as illustrated.

Figure 6:
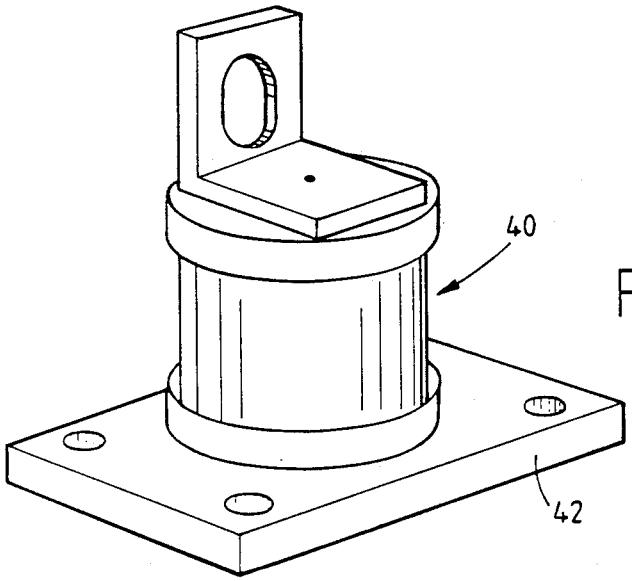
FIG. 6 is a perspective view of a fuse according to a sixth embodiment of the invention.

The embodiment illustrated in FIG. 6 consists of a conventional cylindrical fuse 40 one end of which is welded to a heatsink 42, with no provision for insulation of the fuse from the heatsink.

We claim:

1. A fuse comprising:

a multi-sided fuse element having two ends, two elongate terminals, each terminal connected to a corresponding end of the fuse element for providing electrical connections to the fuse element, a body encapsulating the fuse element and at least a part of each of the terminals, the body including a baseplate comprising a thermally conductive material, the terminals projecting orthogonally with respect to the baseplate, a layer of electrically insulating, heat conducting material provided on the baseplate for insulating the terminals from the baseplate, and an arc quenching material substantially filling the body for permitting dissipation of heat, the arc quenching material surrounding the fuse element on at least three sides and surrounding the part of each terminal encapsulated by the body.

2. A fuse set as forth in claim 1 wherein the fuse element extends between the two elongate terminals intermediate the lengths of the two elongate terminals.

3. A fuse set forth in claim 1, wherein the body comprises an essentially flat metallic baseplate and a housing formed from an electrically insulating material attached to the baseplate.

4. A fuse set forth in claim 2 wherein the body comprises a metallic baseplate having upstanding walls defining a housing, a sealing member provided to extend between the walls for completing and closing the body.

5. A fuse as set forth in claim 2 wherein the sealing member is hermetically sealed to the housing.

6. A fuse as set forth in claim 1 wherein the layer of electrically insulating, heat conducting material comprises a thin layer of ceramic material having two metallized faces, one face being connected to the baseplate and the other face being connected to the terminals.

7. A fuse as set forth in claim 6 wherein the face of the layer connected to the terminals is metallized on a portion of the face so as to define the fuse element, the terminals being electrically connected to the element.

* * * * *